US007191685B2

(12) United States Patent
Lowther

(10) Patent No.: US 7,191,685 B2
(45) Date of Patent: Mar. 20, 2007

(54) DEVICE AND METHOD FOR TRANSFERRING FORCE TO A TARGETED OBJECTED

(75) Inventor: John K. Lowther, Aurora, CO (US)

(73) Assignee: Slide Sledge Technology, Inc., Denver, CO (US)

( * ) Notice: Subject to any disclaimer, the term of this patent is extended or adjusted under 35 U.S.C. 154(b) by 0 days.

(21) Appl. No.: 10/613,777

(22) Filed: Feb. 2, 2004

(65) Prior Publication Data

US 2004/0108121 A1 Jun. 10, 2004

Related U.S. Application Data

(63) Continuation of application No. 10/192,544, filed on Jul. 9, 2002, now abandoned, which is a continuation-in-part of application No. 10/013,411, filed on Dec. 7, 2001, now Pat. No. 6,474,198, which is a continuation-in-part of application No. 09/677,497, filed on Oct. 2, 2000, now Pat. No. 6,349,618, which is a continuation-in-part of application No. 09/281,007, filed on Mar. 30, 1999, now Pat. No. 6,125,719.

(51) Int. Cl.
*B25D 1/00* (2006.01)

(52) U.S. Cl. ..... 81/27; 81/463

(58) Field of Classification Search ..... 81/27, 81/463; 173/90, 91

See application file for complete search history.

(56) References Cited

U.S. PATENT DOCUMENTS 138,098 A 4/1873 Platt
839,246 A 12/1906 Williams
1,067,658 A 7/1913 Joyce, Jr.
1,871,312 A 8/1932 Ferguson
1,903,548 A 4/1933 Kreis (Continued)

FOREIGN PATENT DOCUMENTS

FR 912.611 4/1946

OTHER PUBLICATIONS

Slide Sledge Technology, Inc. "There's a *New* Hitter in Town!" brochure.

(Continued)

*Primary Examiner*—Hadi Shakeri
(74) *Attorney, Agent, or Firm*—Sheridan Ross PC

(57) ABSTRACT

A slide hammer includes three major components, namely, a guide sleeve, a plunger and an impact head. The plunger is inserted within the guide sleeve. The impact head is secured within the distal end of the guide sleeve, and has a portion which protrudes from the guide sleeve distal end. The impact head is able to freely slide within a segmented portion of the guide sleeve distal end, or the impact head movement may be controlled by a spring. The plunger is slid within the guide sleeve at a selected velocity in order to contact the portion of the impact head slidably secured within the guide sleeve. The force of the plunger striking the impact head is transmitted through the impact head to a targeted object in contact with the protruding portion of the impact head. The impact head may be fitted with various types of tips. Each of the tips has particular advantages in applying force to a targeted object.

2 Claims, 15 Drawing Sheets

U.S. PATENT DOCUMENTS

| | | | |
|---|---|---|---|
| 2,475,041 | A | 7/1949 | Mattson |
| 2,587,944 | A | 3/1952 | Williams |
| 2,620,012 | A | 12/1952 | Walsh |
| 2,701,359 | A | 2/1955 | Asbury |
| 3,036,482 | A | 5/1962 | Kenworthy et al. |
| 3,117,378 | A | 1/1964 | Bowen |
| D213,858 | S | 4/1969 | Fortenberry |
| 3,568,657 | A | 3/1971 | Gue |
| D222,329 | S | 10/1971 | Cuscovitch |
| 4,241,795 | A | 12/1980 | Landry, Jr. |
| 4,470,440 | A | 9/1984 | Thor |
| 4,624,323 | A | 11/1986 | Burrola |
| 5,085,281 | A | 2/1992 | Selly |
| 5,329,802 | A | 7/1994 | Nunez |
| 5,370,192 | A | 12/1994 | Evinger |
| 5,461,900 | A | 10/1995 | Gutierrez |
| 5,495,878 | A | 3/1996 | McKenen, Jr. |
| 5,671,814 | A | 9/1997 | Smith |
| 5,699,864 | A | 12/1997 | Dvorak et al. |
| 5,797,300 | A | 8/1998 | Fairbanks |
| 5,875,951 | A | 3/1999 | Ingle et al. |
| 5,878,822 | A | 3/1999 | Roy |
| 5,934,139 | A | 8/1999 | Tucker |
| 6,109,365 | A | 8/2000 | Lamoureux et al. |
| 6,125,719 | A | 10/2000 | Lowther et al. |
| 6,318,228 | B1 | 11/2001 | Thompson |

OTHER PUBLICATIONS

Lowther, "Explanation of Applicant's Prior Art", Jul. 1, 1999, pp. 1-2 (with photographs).

"Explanation of Prior Art Cited by Applicant": Non-Patent Document AL in Information Disclosure Statement.

315
312
310
13
12
10'
10
280
294
33
324
286
296
284
304
290
298
37
288
282
299
300
302

DEVICE AND METHOD FOR TRANSFERRING FORCE TO A TARGETED OBJECTED

CROSS REFERENCE TO RELATED APPLICATIONS

The present application is a continuation of U.S. patent application Ser. No. 10/192,544, filed Jul. 9, 2002 now abandoned, entitled "SLIDE HAMMER", which is incorporated herein by this reference.

This application is a continuation-in-part application of U.S. Ser. No. 10/013,411 filed on Dec. 7, 2001 now U.S. Pat. No. 6,474,198 entitled "SLIDE HAMMER", which is a continuation-in-part application of U.S. Ser. No. 09/677,497, filed Oct. 2, 2000, entitled "SLIDE HAMMER", now U.S. Pat. No. 6,349,618, which is a Continuation-in-Part application of U.S. Ser. No. 09/281,007, filed Mar. 30, 1999, entitled "SLIDE HAMMER", now U.S. Pat. No. 6,125,719.

TECHNICAL FIELD

This invention relates to a device which transfers the force of an impact to a targeted object and, more particularly, to a slide hammer which transfers the force of an impact to a targeted object.

BACKGROUND OF THE INVENTION

It is known to use various combinations of chisels and hammers in order to impart a force upon a targeted object. In the automotive repair industry, it is often necessary to reshape and straighten vehicle body frames which have been damaged. Various forms of frame straightening machines are available for such purposes. However, even with the availability of such machines, it is still necessary in most cases to apply manual force to the frame in order to achieve the exact type of reshaping necessary to straighten the frame. Particularly for hard-to-reach locations on the vehicle frame, pneumatic or hydraulic machines are simply not able to be positioned in a manner to provide force against the targeted frame location. Also, for intricate reshaping of smaller frame members, machines are unsuitable. Thus, the straightening of a vehicle body frame still requires a considerable amount of manual labor.

One disadvantage of using a hammer and chisel is that the hammer and chisel have to be firmly gripped. Because metal to metal contact is made between the frame and the chisel, most of the force of the impact is transmitted back through the user's hands and arms. This force transmitted back through the hands and arms of a person can cause great pain and discomfort, as well as to cause premature fatigue. Because the hammer has to be swung with great force, the hammer itself can become a danger, particularly in hammering out those hard-to-reach locations on the frame. These and other known hazards make the use of a chisel and hammer undesirable.

Therefore, a need exists for a device which can be safely and easily manipulated by a user for applying a desired amount of force to a targeted object. A need also exists for a hammering device which allows a user to vary the amount of force applied by the device without having to substantially change the user's physical efforts in manipulating the device.

It is one object of this invention to provide a slide hammer device which is able to transfer the force of an impact to a specific targeted object. It is another object of this invention to provide a slide hammer device which minimizes the reaction force which is transmitted back through the user's hands and arms. It is yet another object of this invention to provide increased safety with a hammering device. It is yet another object of this invention to provide a hammering device which has removable and varying tip configurations in order to further control the type of force applied to the targeted object. These objects and others will be explained more fully below as they apply to the slide hammer device of this invention.

SUMMARY OF THE INVENTION

In its simplest form, the slide hammer of this invention is a hammering device which allows the force of an impact to be transferred to a targeted object. The apparatus has three major components, namely, a guide sleeve, a plunger, and an impact head. The plunger is inserted within the guide sleeve. The impact head is secured within the distal end of the guide sleeve, and has a portion which protrudes from the guide sleeve distal end. In one configuration, the impact head is able to freely slide within a specified portion of the guide sleeve distal end. In another configuration, a spring can be used to stabilize the impact head within the guide sleeve. The plunger is slid within the guide sleeve and is able to make contact with the portion of the impact head slidably secured within the guide sleeve. The force of the plunger striking the impact head is transmitted through the impact head to a targeted object contacted by the impact head, such as a vehicle frame member. The impact head may be fitted with various types of tips. The particular tip chosen is based upon the type of force which is to be applied upon the targeted object. The exterior dimension of the plunger and the channel or opening in the guide sleeve are sized for a relatively close tolerance fit which ensures a smooth sliding movement of the plunger within the guide sleeve. The portion of the impact head secured within the guide sleeve distal end is also sized so that it maintains a relatively precise sliding movement within the guide sleeve. Optionally, various sized weights may be added to the plunger in order to increase or decrease the amount of force which is transmitted from the plunger to the impact head. A removable handle may be mounted to the guide sleeve in order to further reduce the shock of the impact which is transmitted back through the user's hands and arms, and also to allow the device to be more easily gripped during use. Also, a removable support may be used when the device is used to apply force to an object on the ground, such as concrete or asphalt.

The use of the guide sleeve to guide the plunger greatly increases the accuracy at which a force is applied and to a targeted object. Not only can the angle at which the force is applied be better controlled, but also the magnitude of the applied force as well. The guide sleeve acts as an alignment means for directing the force at a desired angle. Since the plunger travels along this aligned path, the angle at which the force is applied to a targeted object is very accurate. With a hammer and chisel, it is much more difficult to maintain this aligned path between the chisel axis and the angle at which the hammer strikes the chisel head; therefore, the angle at which force is applied to a targeted object is more inconsistent. In terms of force magnitude, the plunger may be slid within the guide sleeve at the appropriate velocity to increase or decrease the force transmitted through the impact head. The use of the guide sleeve in conjunction with the plunger also makes the application of force safer since there is no possibility that the plunger will become disengaged from or otherwise slip away from the impact head during impact. Since the plunger may be slid within the guide sleeve as opposed to being independently lifted or carried throughout a striking motion, the user must only overcome the slight friction between the guide sleeve and the plunger to move the plunger for contact with the impact head. The plunger may be lubricated as necessary to further reduce the amount of effort required to slide the plunger within the guide sleeve. The removable weights attached to the plunger can allow one to further vary the force applied. Additionally, the guide sleeve and plunger may be made longer or shorter depending upon the particular application and the amount of force to be applied to the targeted object. Because the impact head may be fitted with removable tips, the slide hammer is adaptable for use in many applications.

The impact head receiving section may be removable from the rest of the guide sleeve which allows the impact head receiving section to be replaced with different sized impact heads. Additionally, use of a removable impact head receiving section allows replacement of this section which undergoes greatest stress and strain and therefore damage over time. Conveniently, the distal end of the guide sleeve may be threaded for receiving the removable impact head receiving section.

As briefly mentioned above, a spring may be placed within the impact head receiving section to thereby stabilize the impact head within the section or alternatively, no spring may be used which allows the impact head to freely slide. The advantage of using a spring within the impact head receiving section is that it helps stabilize the impact head prior to impact with the plunger; however, a disadvantage is that the force of the plunger against the impact head is somewhat dampened by use of the spring thereby reducing the transfer of force from the plunger to the impact head.

The use of the slide hammer of the present invention results in less force being transmitted back through the hands and arms of a user. When the plunger achieves the desired velocity within the guide sleeve, the user's hand need not be gripped tightly around the proximal end of the plunger which, in turn, reduces the amount of force transmitted back through that hand. As discussed above with respect to a standard hammer and chisel, a hammer must always be tightly gripped during impact against the chisel which, in turn, results in much greater force being transmitted back through the hand. Also, since the impact head is able to slide along a specified length within the guide sleeve, the guide sleeve itself may recoil and absorb the retransmitted impact force which further reduces the shock experienced by the user's hand which grips the guide sleeve. In general, the sliding engagement of the impact head and the plunger within the guide sleeve combines to enhance the shock absorption characteristics of the slide hammer.

Since the impact head is able to slide with minimal resistance within the specified portion of the guide sleeve, the full impact of the moving plunger may be transmitted to the impact head which, in turn, helps to ensure that an adequate force is applied to the targeted object.

These and other advantages will become more apparent by a review of the following figures, in conjunction with the detailed description.

DETAILED DESCRIPTION

Figures 1, 2, 3:
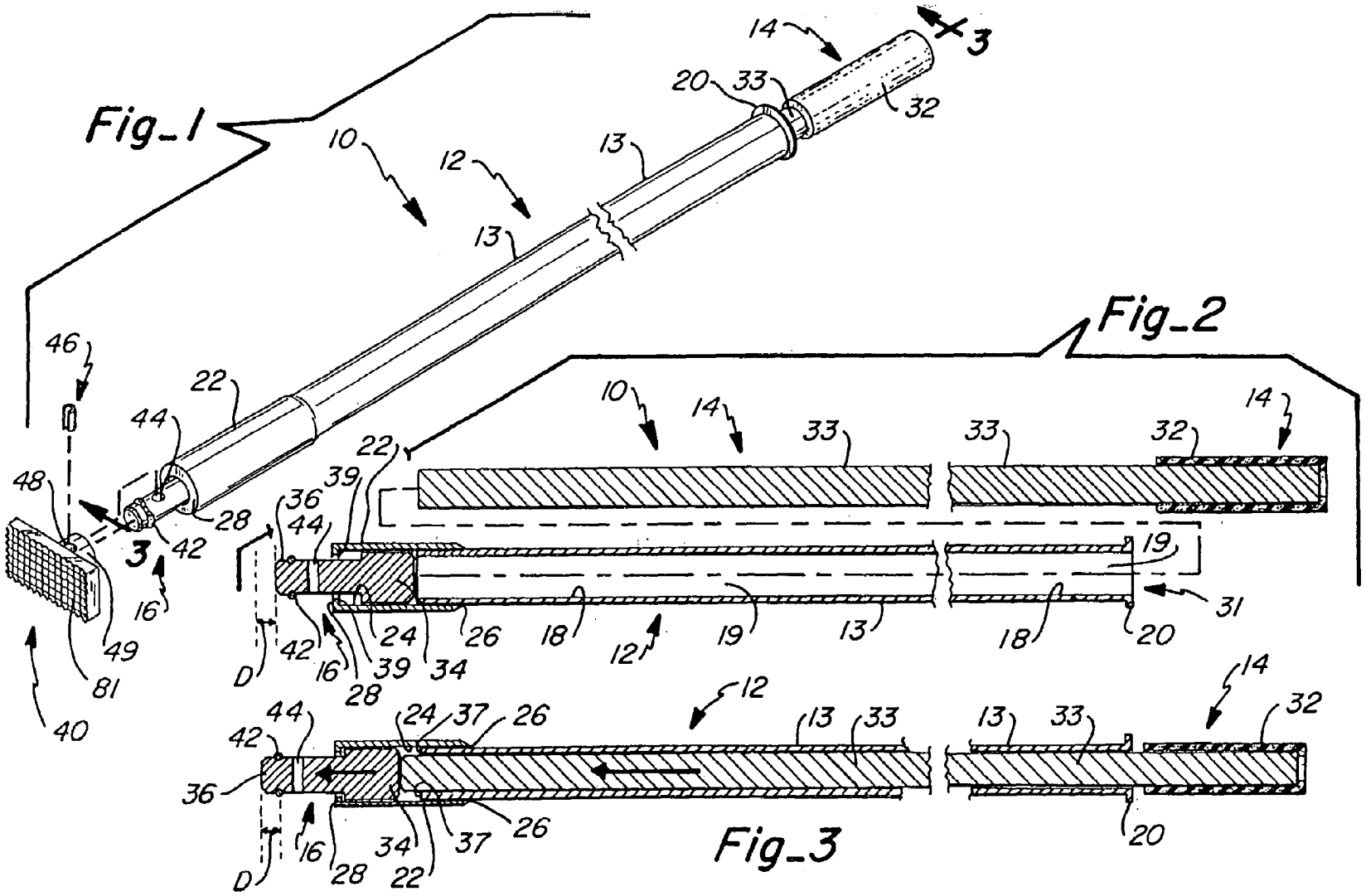
FIG. 1 is a partially exploded fragmentary perspective view of the slide hammer of this invention.
FIG. 2 is a partially exploded vertical section, taken along line 3—3 of FIG. 1.
FIG. 3 is a vertical section, taken along line 3—3 of FIG. 1.

As shown in FIGS. 1–3 in a first embodiment, the slide hammer 10 includes three major components, namely, a guide sleeve 12, a plunger 14 that is slidably engaged within said guide sleeve, and an impact head 16 which is slidably secured within the distal end of the guide sleeve 12. The guide sleeve 12 is preferably of a cylindrical shape, and has a main guide sleeve section 13 and a corresponding inner cylindrical surface 18 forming a longitudinal passageway 19. A flange 20 is formed at the proximal end of the guide sleeve. The guide sleeve 12 further includes an impact head receiving section 22. As shown in the vertical sections of FIGS. 2 and 3, receiving section 22 has an inner cylindrical surface 24 which is of a slightly larger diameter than inner surface 18. Receiving section 22 may simply be a larger sized cylinder pipe member which overlaps with main guide sleeve section 13 at welded joint or overlap area 26. The distal end of head receiving section 22 has a washer or distal stop 28 welded thereto. Alternatively, the distal end of the main guide sleeve section 13 may have external threads which mate with internal threads formed on the proximal end of receiving section 22. Thus, receiving section 22 can be removed from the main guide sleeve section 13. Periodically, it may be necessary to clean the interior of receiving section 22. Furthermore, any damage to the receiving section 22 or to the impact head 16 can be remedied by replacing these components as opposed to replacing the entire device.

Plunger 14 is a solid and cylindrical shaped member including a main shaft or rod 33. A gripping means or handle 32 may be attached to the proximal end of plunger 14. The distal end of plunger 14 is inserted within the opening 31 and into passageway 19 of guide sleeve 12. Plunger 14 is slidable within passageway 19 of guide sleeve 12 to make contact with impact head 16. The extent to which plunger 14 is inserted within passageway 19 of guide sleeve 12 may be limited by contact of the handle 32 against flange 20. The distal end of plunger 14 must be able to be inserted far enough within guide sleeve 12 to make contact with impact head 16. As also shown in FIGS. 1–3, impact head 16 includes a slide portion 34 which is slidable within guide sleeve 12 along inner surface 24, and an impact extension 36 which protrudes through washer/stop 28. Impact head 16 may simply be a solid member having two distinct cylindrical sections of differing diameters, namely, impact extension 36 being smaller and slide portion 34 being larger. As shown in FIGS. 2 and 3, impact head 16 is free to slide along inner surface 24 and in the open space between the distal end 37 of main section 13, and the inner surface 39 of washer/stop 28. Thus, the distal end 37 of main section 13 forms a proximal stop to limit the proximal travel of impact head 16 while distal stop 28 limits the distal travel. The amount of displacement or movement within receiving section 22 by impact head 16 is shown as distance D in FIGS. 2 and 3. This distance D may be adjusted as desired by either increasing or decreasing the length of slide portion 34, or by increasing or decreasing the length of head receiving section 22. Additionally, while the preferred embodiment shows the guide sleeve 12 and plunger 14 being of certain relative lengths, it shall also be understood that the lengths of these members may also be increased or decreased as desired.

Figure 4:
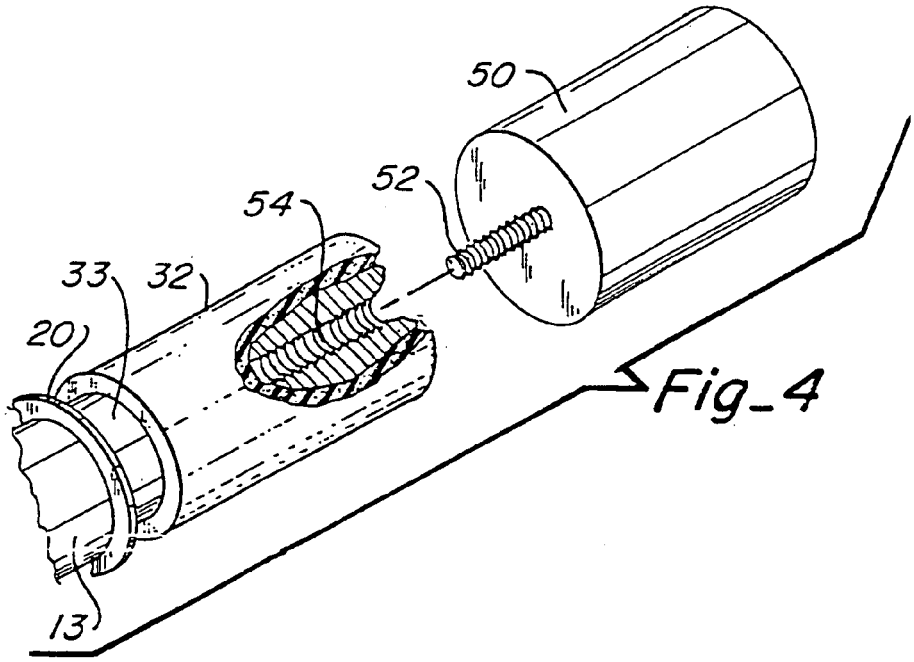
FIG. 4 is an enlarged fragmentary exploded perspective view illustrating a removable weight attached to the proximal end of the plunger.

Now referring to FIG. 4, a weight 50 may removably attach to the proximal end of plunger 14 in order to vary the amount of force which is applied to a targeted object. As shown, weight 50 may simply be another solid, cylindrical member with a protruding threaded screw 52 which is screwed into a corresponding threaded well 54 formed in the proximal end of plunger 14. Alternatively, the proximal end of the plunger 14 may have a threaded screw 52, and weight 50 may have a corresponding threaded well for receiving the screw. The specific mass of weight 50 may be adjusted to modify the force to be applied.

Figure 5:
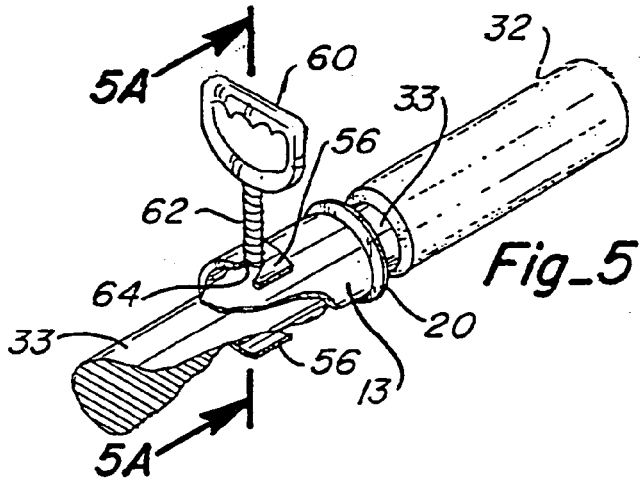
FIG. 5 is a fragmentary perspective view of an integral collar and extending handle which may attach to the guide sleeve to further assist a user in holding the slide hammer during use.
Figure 5A:
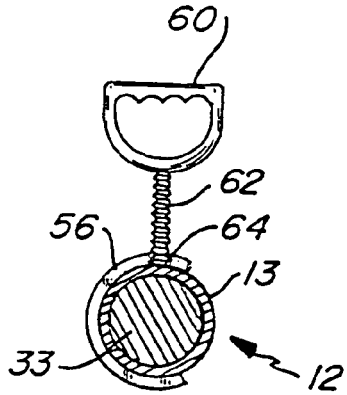
FIG. 5A is a vertical section, taken along line 5A—5A of FIG. 5.

Now referring to FIGS. 5 and 5A, means may be provided on guide sleeve 12 for holding or securing the guide sleeve during use, and further to dampen or reduce the amount of shock that is transmitted to the user. As shown, a collar 56 is placed over the guide sleeve 12, and a handle 60 with a protruding threaded screw or nut 62 is received within a threaded well 64 which extends completely through collar 56. The leading or distal tip of threaded nut 62 contacts the guide sleeve 12 to secure the handle 60 in place. The collar 56 may be placed at any point along the length of the guide sleeve 12.

Figure 6:
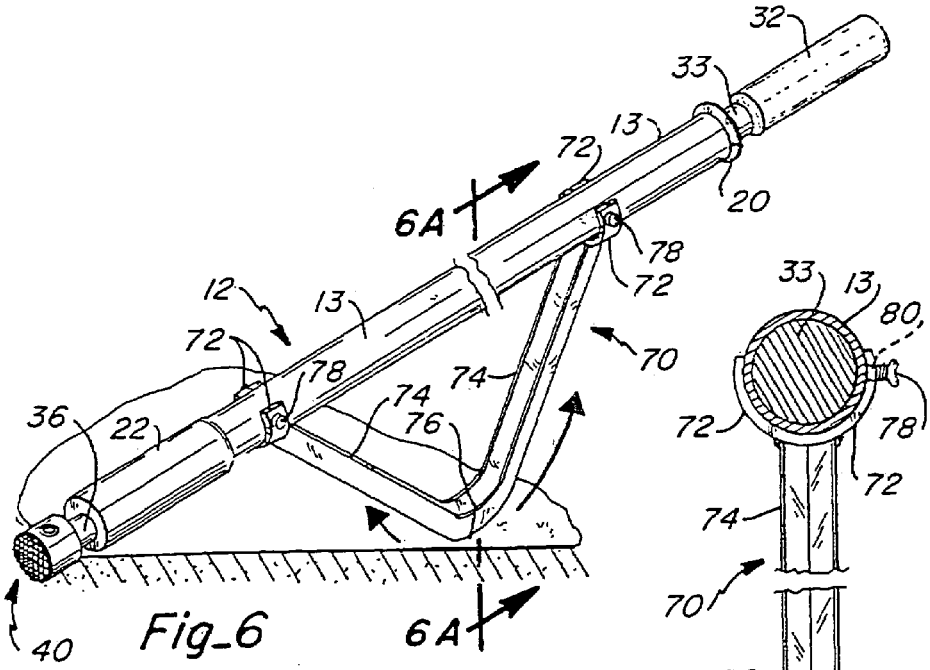
FIG. 6 is a perspective view of the slide hammer and a ground support accessory for supporting the slide hammer when used to contact an object on the surface of the ground.
Figure 6A:
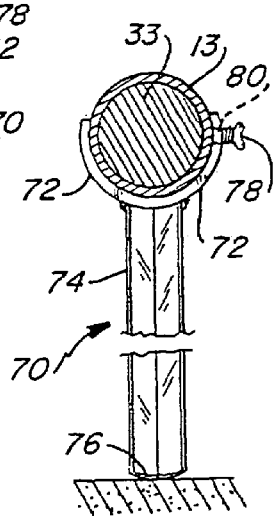
FIG. 6A is an enlarged vertical section, taken along line 6A—6A of FIG. 6.

In some applications, it may be necessary to apply a force to an object which is on the surface of the ground. In such applications, it is advantageous to have a support which helps in steadying the guide sleeve 12. Accordingly, FIG. 6 illustrates an accessory in the form of a support 70 which may be used in such circumstances. Support 70 may include a pair of spaced collars 72 interconnected by a curved brace 74. A pivot or contact point 76 is formed approximately midway between collars 72. This pivot/contact point 76 is placed on the ground. Collars 72 may simply be U-shaped members, as shown in FIG. 6A. A tightening nut 78 is received in a threaded well 80 formed in collars 72. The leading or distal tip of tightening nut 78 contacts guide sleeve 12 to secure the brace 70 in place. Although a pair of collars are shown, it shall be understood that only one collar is necessary for support 70. Accordingly, brace 74 could simply be a straight member which extends from collar 72 and has a distal end which contacts the ground.

Depending upon the type of impact or force to be applied to a targeted object, a number of different types of interchangeable tips 40 may be employed. As discussed further below, FIG. 1 and FIGS. 17–49 illustrate examples of interchangeable tips 40. These tips 40 can be working tools, adapters, or extensions. Each of the interchangeable tips 40 include a bore or channel 47 formed in a receiving section 49 to receive impact extension 36. Interchangeable tips 40 may be secured to impact section 36 in any number of well-known means. For example, a circumferential groove may be formed on the exterior surface of impact extension 36 and a biased split ring 42 may be secured within the groove. The split ring 42 provides the desired flexible friction against the tip 40. Alternatively, or in conjunction with the use of split ring 42, a hole 44 may be drilled through impact extension 36. A roll or cotter pin 46 may then be used to secure the tip 40. If such a pin 46 is used, a corresponding hole 48 may be drilled in receiving section 49 of the tip 40.

Split ring 42, in the alternative, can represent an o-ring which is secured within the radial groove. The o-ring can be sized to provide a friction fit between the impact extension 36 and the interior surface of the receiving section 49. Furthermore, the cotter pin 46 could also be used in conjunction with the o-ring in order to secure the tip 40. Those skilled in the art can envision other ways in which the tips 40 may be attached to the impact extension 36.

Also, each of the tips 40 could be fitted with a ball and socket-type connection (not shown) at receiving sections 49. These rotatable connections would further allow the slide hammer to be positioned in hard-to-reach locations in order to apply a force at an exact desired angle.

In operation, the tip 40 is placed against the targeted object. Preferably, the impact head is placed in the retracted position of FIG. 2, or at least in a partially retracted position. The slide hammer is then positioned at the desired angle with respect to the targeted object. The plunger is then moved at the desire speed within the guide sleeve to contact the impact head. The greater the velocity, the greater the force applied through the impact head to the targeted object. When the force of the impact head is transferred to the targeted object, in accordance with basic physics principles, an equal and opposite reaction will be transmitted back through the impact head. Some of this force will be transmitted back through the guide sleeve, but since the guide sleeve is not rigidly connected to the impact head, a much lesser force will be transmitted through the guide sleeve. Thus, the hand holding the guide sleeve should not experience undue shock. The majority of the recoil or reaction force will be transmitted back through the plunger. Because the user's hand does not need to firmly grasp the plunger, less force will be transmitted back through the user's hand and arm which manipulates the plunger. Additionally, the handle 32 will absorb some of the recoil. In those circumstances when the slide hammer is in use and when the handle 32 is held at a higher elevation than the distal end 30, it may not be necessary to continue to grasp the plunger after its sliding movement within the guide sleeve 12 has reached the desire velocity. Accordingly, no shock or recoil is transmitted through the user's hand or arm. Depending upon the length of the guide sleeve, however, it may be necessary to monitor the recoil of the plunger so it does not completely exit the guide sleeve or otherwise contact the user during recoil.

Even if the impact head 16 is in the full extended position of FIG. 3 when the plunger makes contact with the impact head, minimal recoil or reaction forces will be generated through the guide sleeve. Additionally, the vibrations caused by the impact with the targeted object will cause at least some inherent sliding movement of the impact head in the proximal direction which, in turn, will help to dissipate or dampen the recoil. Therefore, regardless of whether the slide hammer is in the fully retracted or extended position, the slide hammer is effective in allowing a force to be projected onto a targeted object without sacrificing safety or comfort for the user.

Figure 7:
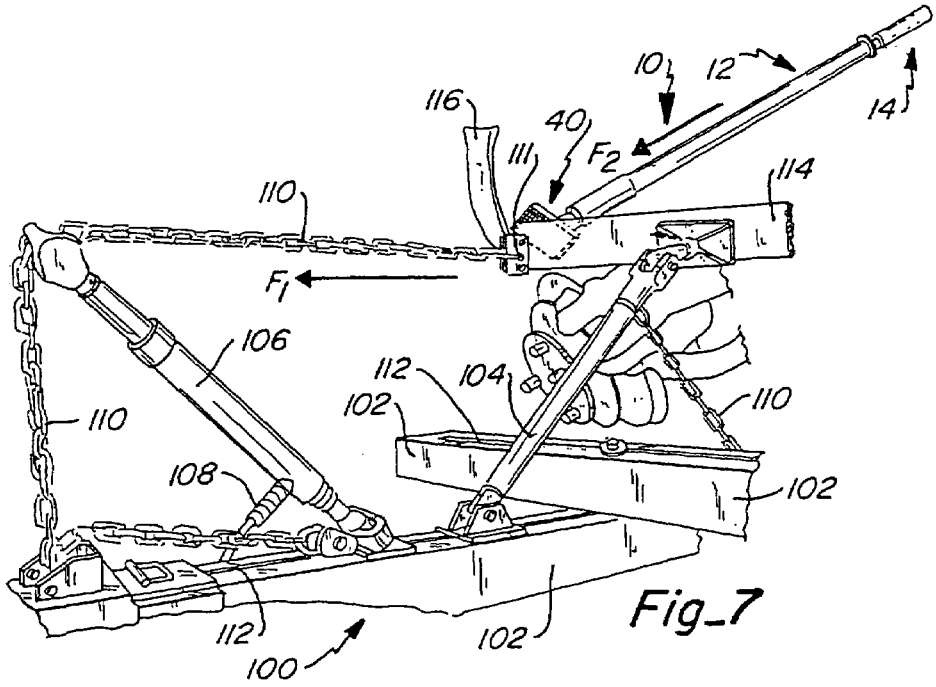
FIG. 7 is a fragmentary perspective view of a vehicle mounted to a frame pulling machine, and the slide hammer of this invention positioned to apply a force against the vehicle frame.

FIG. 7 illustrates how the slide hammer 10 of this invention may be used to apply a force to the portion of the frame of a vehicle near a wheel assembly which must be straightened. As shown, the vehicle may be mounted upon a frame machine or rack 100. Common frame machines 100 include a plurality of beams 102, and braces 104 which may be positioned at the desired points along the vehicle frame. A hydraulic or pneumatic cylinder 106 communicates with a hydraulic or pneumatic pump (not shown) through line 108. A chain 110 is secured between a beam 102 and an attachment point 111 on the vehicle frame. Slots or grooves 112 in beams 102 allow the braces 104 and the cylinders 106 to be positioned as desired. In the particular example of FIG. 7, cylinder 106 is extended which results in a force applied by chain 110 in force direction $F_1$. This results in a force being placed upon longitudinal frame member 114. A vertically extending and curved frame member 116, which is welded to longitudinal frame member 114 at attachment point 111, is also placed under stress by chain 110. The slide hammer 10 may then be used to apply the necessary force to bend frame members 114 and 116. As shown, slide hammer 10 is simply placed on the opposite side of attachment point 111 and a force $F_2$ is applied by striking the plunger 14 against impact head 16.

Figures 8, 9, 10:
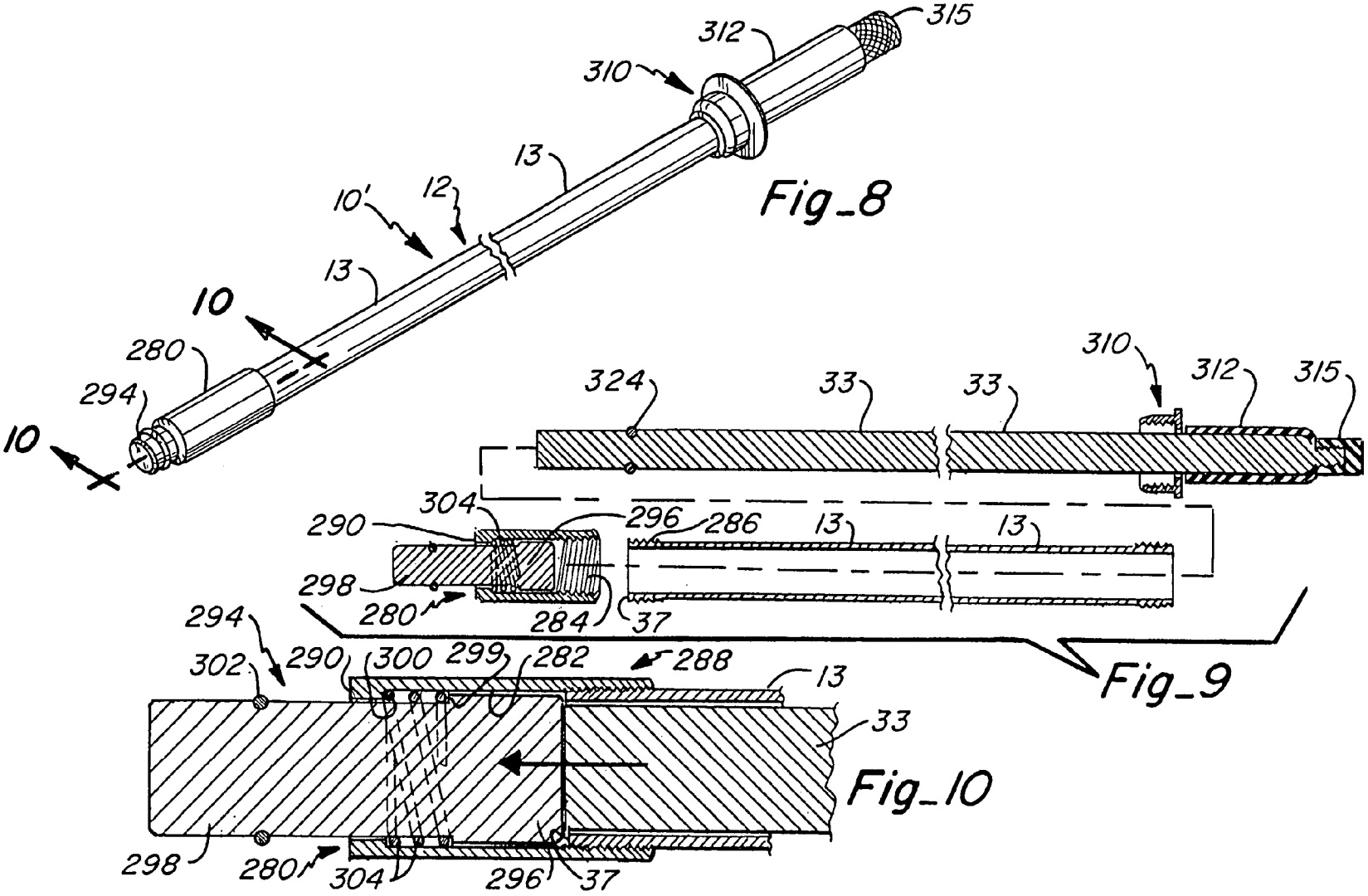
FIG. 8 is a fragmentary perspective view of a second embodiment of the slide hammer of this invention.
FIG. 9 is a partially exploded vertical section of FIG. 8.
FIG. 10 is another partially exploded vertical section, but enlarged and taken along line 10/10 of 8.

FIGS. 8–10 illustrate another embodiment of the present invention. Like reference numbers for this embodiment correspond to the same items as set forth in the first embodiment. The primary structural differences in the second embodiment is the inclusion of a removable head receiving section 280, and a different arrangement for the proximal end of the slide hammer wherein an end cap 310 prevents removal of the plunger from within the guide sleeve.

The removable head receiving section 280 is similar to the head receiving section 22 of the first embodiment; however, the head receiving section is threadably connected to the distal end of the guide sleeve. As shown, receiving section 280 includes an inner cylindrical surface 282 with internal threads 284 formed thereon. The distal end of the guide sleeve 13 includes external threads 286 which mate with the internal threads 284. Accordingly, the connection between the head receiving section 280 and the distal end of the guide sleeve forms a joint/junction 288. The distal end of the head receiving section 280 has a distal stop or integral flange 290 which forms a slightly smaller diameter opening to prevent the impact head 294 from being removed therefrom. The impact head is structurally the same as in the first embodiment. Accordingly, the impact head 294 includes a slide portion 296, and an impact extension 298 which extends distally from the distal end of the head receiving section. Optionally, a spring 304 may be placed in the gap between the interior shoulder 300 of the flange 290 and the shoulder 299 defining the interface between the impact extension 298 and slide portion 296. The spring 304 preferably does not have an excessive compression required to compress the spring, thereby limiting the dampening effect of the spring which would otherwise prevent the full force of the plunger from being transferred to the impact head. The advantage of using a spring is to better stabilize the slide hammer for applying a directed force. The spring ensures that the tip is more easily held against the work piece since the impact head will not freely slide within the head receiving section 280. Also shown is a split ring 302 attached to the impact head which facilitates attachment to one of the tips 40.

Figure 15:
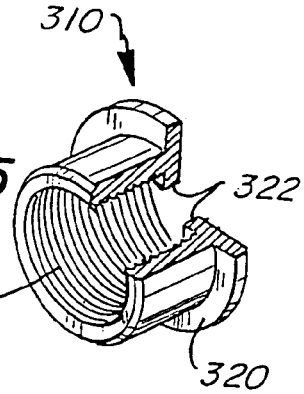
FIG. 15 is an enlarged fragmentary perspective view of a removable cap which may be attached to the proximal end of the guide sleeve.
Figure 16:
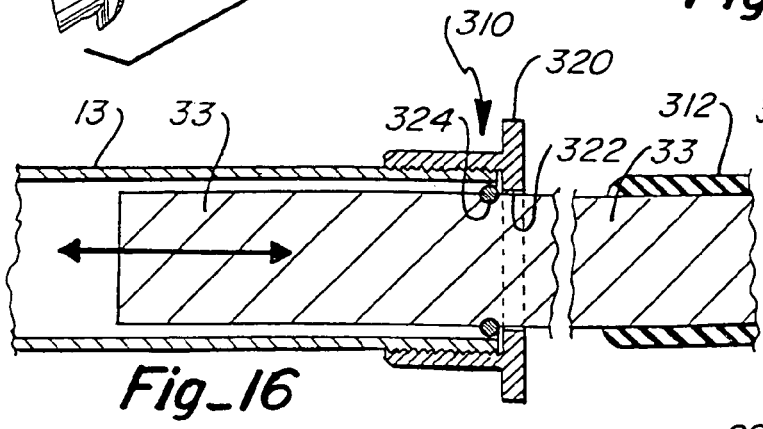
FIG. 16 is an enlarged fragmentary vertical section of the proximal end of the guide sleeve illustrating the removable end cap which secures the plunger to prevent the plunger from being removed from within the guide sleeve.

Now referring to FIGS. 9 and 14–16, the second embodiment also includes a removable end cap 310 which is threadably received on the proximal end of the guide sleeve. A handle 312 of a rubber or resilient type of material may be attached to the proximal end of the plunger to facilitate grasping by the user. Additionally, the proximal end of the plunger may include a threaded extension 314 which may be used to attach a desired weight 316 thereto. Referring specifically now to FIG. 15, the end cap 310 is shown. It includes a plurality of internal threads 318, a flange 320, and an inner concentric extension or flange 322. A resilient cover 315 (FIG. 8) may be placed over the exposed threads 314 when a weight 316 is not used. As seen in FIG. 16, when the plunger is nearly completely withdrawn from the guide sleeve, a split ring 324 attached to the plunger prevents the plunger from being removed from the guide sleeve as the split ring contacts the smaller diameter portion formed by flange 322. The diameter of the split ring 324 has been shown somewhat enlarged so to clearly see how it prevents removal of the plunger; however, in practice, the split ring is smaller so as to still facilitate smooth slidable movement of the plunger.

Figure 11:
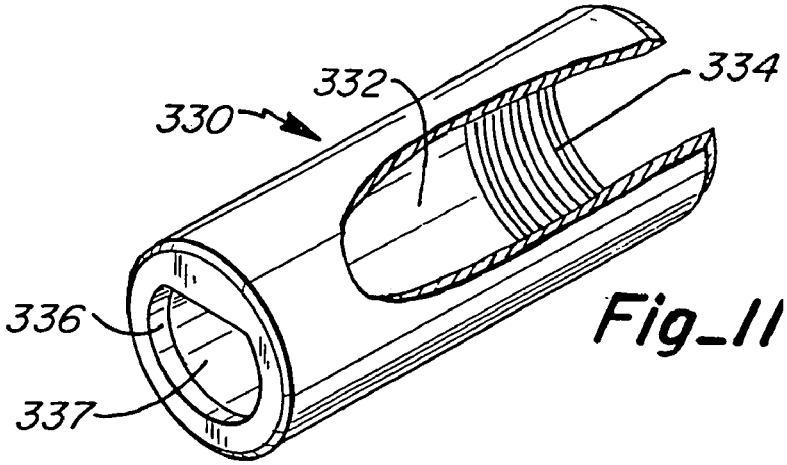
FIG. 11 is an enlarged fragmentary perspective view of another type of removable receiving section.
Figure 12:
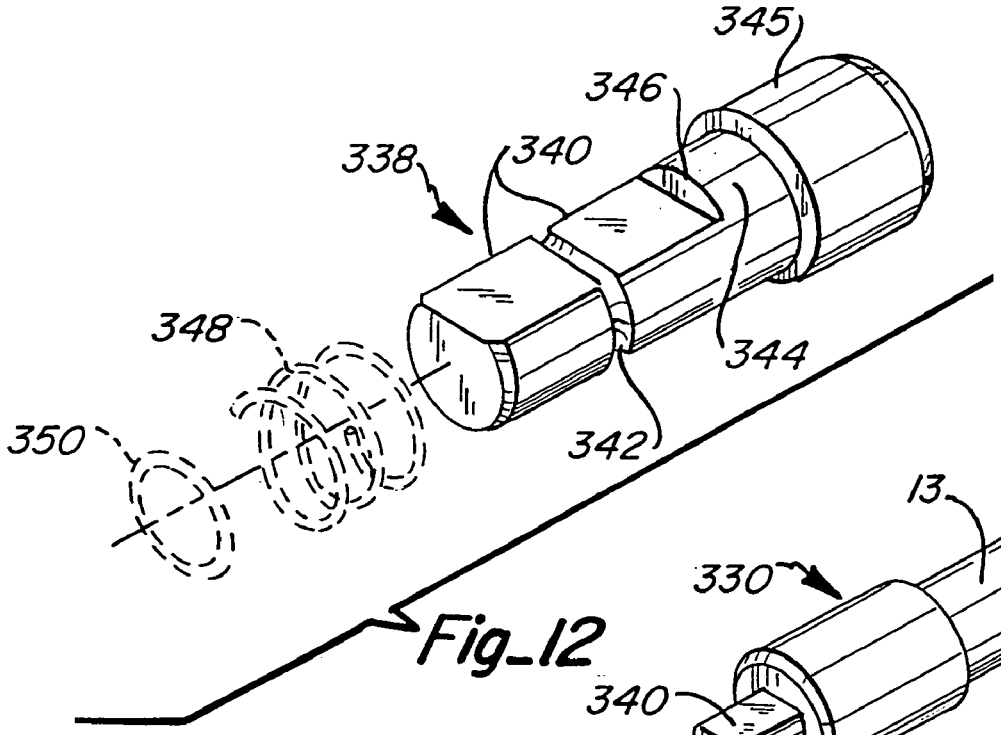
FIG. 12 is a perspective view of the type of impact head which is received in the receiving section of FIG. 11.
Figure 13:
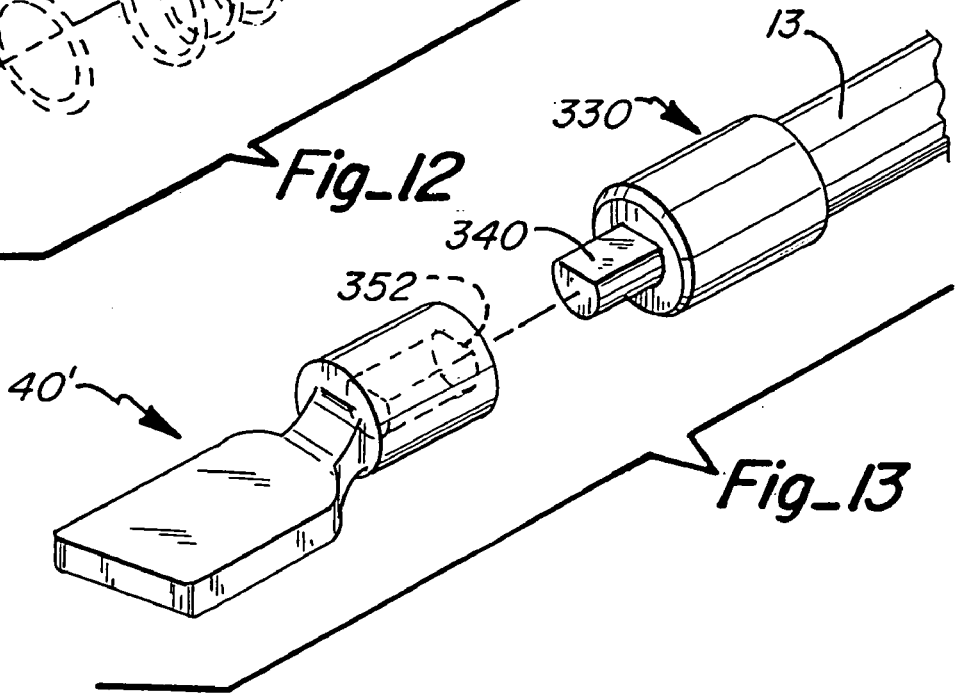
FIG. 13 is a fragmentary perspective view of a slide hammer illustrating the receiving section of FIG. 11 attached to the guide sleeve, and one example of a tip which is adapted to receive the impact head extension of FIG. 11.
Figure 14:
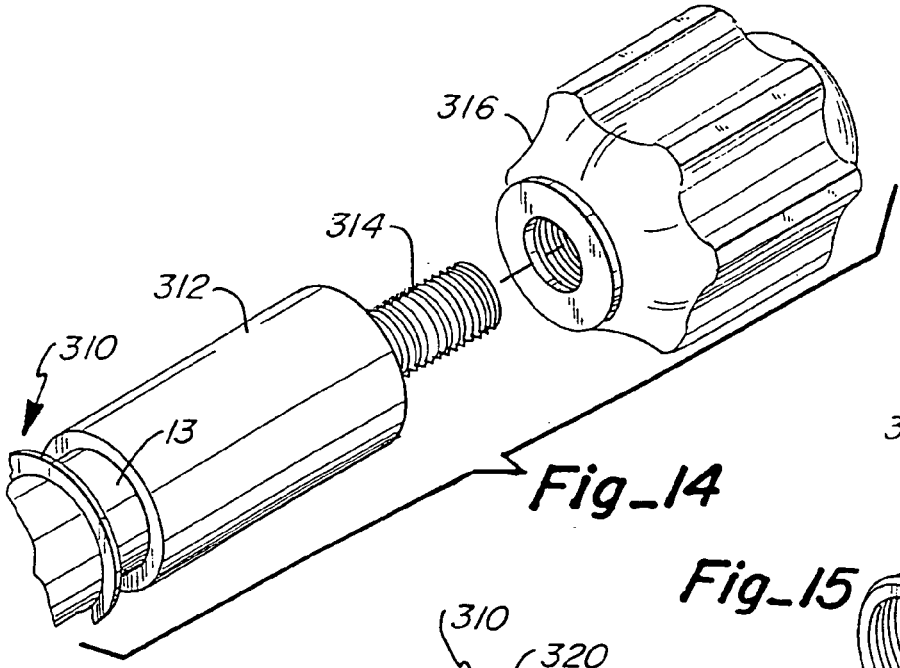
FIG. 14 is an enlarged fragmentary perspective view of the proximal end of the slide hammer of FIG. 8.

Now referring to FIGS. 11–13, a modification is provided to the removable head receiving section 280. As shown, the modified head receiving section 330 has a D-shaped opening 337 formed by the distal stop or end 336. The D-shaped opening in the head receiving section is adapted to receive the modified impact head 338 which also has a D-shaped cross-section. As with the head receiving section 280, head receiving section 330 has a plurality of internal threads 334 which allow it to be threadably received on the distal end of the guide sleeve. The impact head 338 is received within the head receiving section 330, and is slidable within the inner cylindrical area 332. The impact head 338 has a D-shaped section 340, a cylindrical section 344, and a shoulder 346 which is formed between section 340 and 344. A larger cylindrical section 345 may be provided proximally of section 344. Optionally, a spring 348 may also be provided having one end which abuts the shoulder 346 and the opposite end which abuts the interior surface (not shown) of the distal stop 336 when assembled. Also, the impact head may further include a groove 342 which receives a split ring 350 thus facilitating attachment to a desired tip 40.

Referring to FIG. 13, the D-shaped section 340 is then insertable within a tool 40' which has a corresponding D-shaped opening 352. The D-shaped arrangement of the head receiving section 330 prevents the impact head 338 from rotating because D-shaped section 340 is captured by the D-shaped opening 337. Thus, the tip 40' is also prevented from rotating when a force is transferred to the tip 40'.

Figure 17:
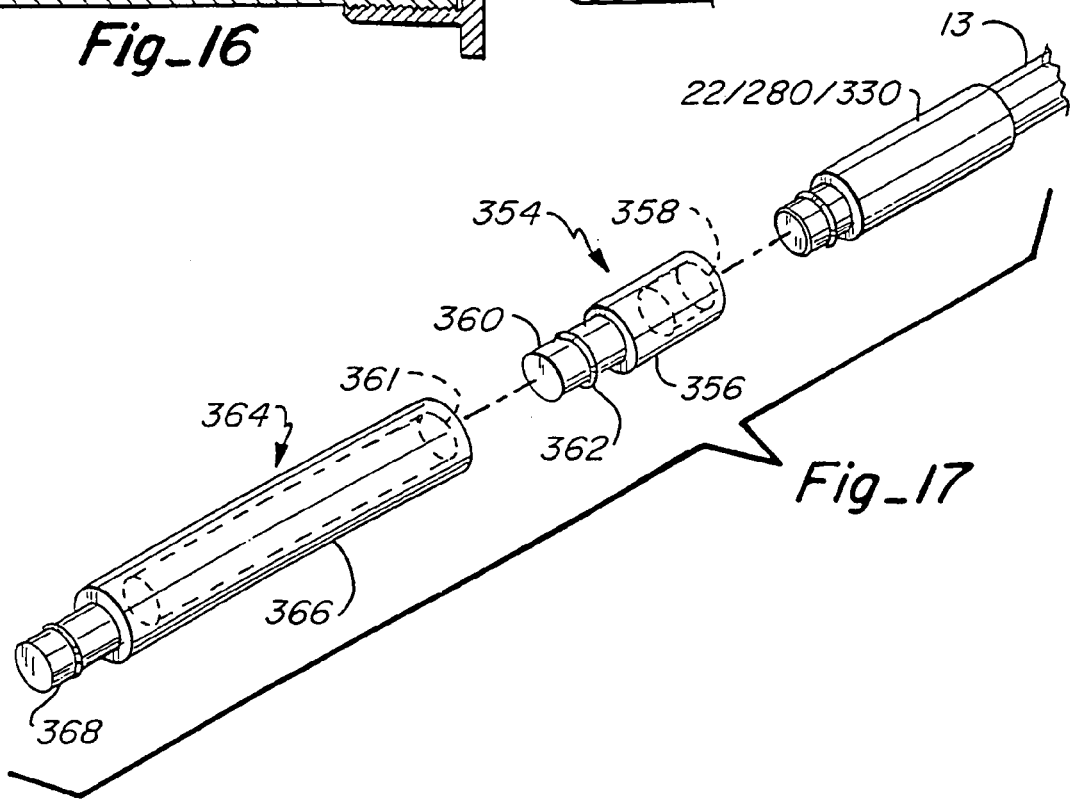
FIG. 17 is a perspective view of an adaptor which is illustrated for use with the slide hammer of the present invention to couple the slide hammer to a standard extension.

Now referring to FIG. 17, an adaptor 354 is provided which allows the slide hammer to connect to a commercially available extension 364. The adapter 354 comprises a receiving section 356 having a cylindrical opening 358 formed therethrough for receiving the impact extension of the head receiving section 22/280/330. The distal end of the adapter 354 includes an extension 360 which is insertable within a cylindrical opening 361 in the standard extension 364. Optionally, a split ring 362 may be attached to the extension 364 facilitating a firm attachment to the standard extension 364. The standard extension 364 simply includes a cylindrical sleeve or section 366 having the opening 361 formed therethrough. The distal end of the standard extension 364 also includes its own extension 368 which is then connected to the desired tip 40.

The following is now a description of the various tips or ends 40 which may be used with the present invention.

Some of these tips are the same as tips which may found in commercially available applications to include hydraulic ram sets such as a Port-A-Power™ hydraulic ram sets. Specifically, the removable tips shown in FIGS. 19, 20, 22, 25 and 27 may be found in commercially available ram sets. The tip shown in FIG. 8 is not used in ram sets, but has a configuration with its working end that is known for use in removing scarifying teeth of a motor grader.

Figure 18:
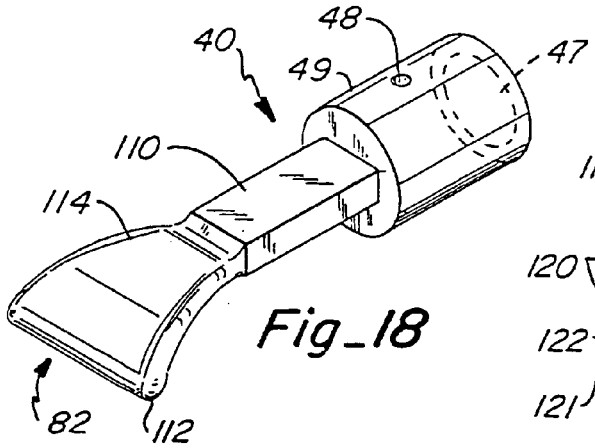
FIGS. 18–27 are enlarged perspective views of tips which may be used with the slide hammer.

FIG. 1 illustrates a rectangular shaped tip 81 having a waffle-like contacting surface. FIG. 18 shows a tip 40 having a curved configuration 82 including a flat shank 110 integral with a curved neck 114 which transitions from smaller to larger as it approaches the working end 112. End 112 is blunted. Thus, the removable tip of FIG. 18 is able to impart an angular force with respect to the orientation of the slide hammer.

Figure 19:
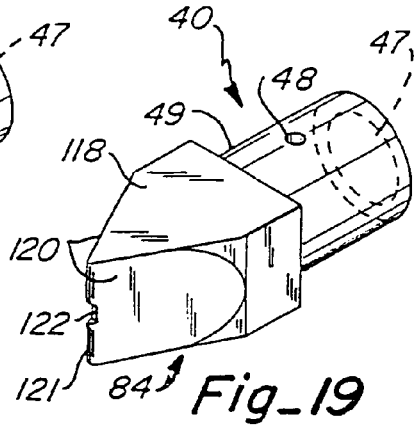

FIG. 19 illustrates a chisel-type tip 84 that can be further defined as including a body or block portion 118 with a pair of converging side walls 120 forming the working end 121. A notch 122 may be cut out of the working end 121. The removable tip illustrated in FIG. 19 is especially adapted for separating two pieces of joined metal. The working end 121 is inserted between the pieces to be separated. The converging side walls 120 separate the two pieces as the working end is driven between the pieces.

Figure 20:
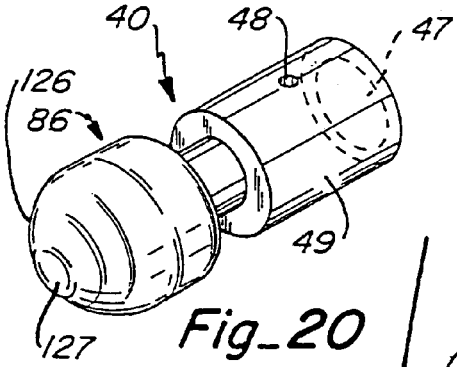

FIG. 20 illustrates a rubber, mallet-type tip 86 that can be further defined as including a semi-spherical converging portion 126 terminating in a flat or slightly rounded working end 127.

Figure 21:
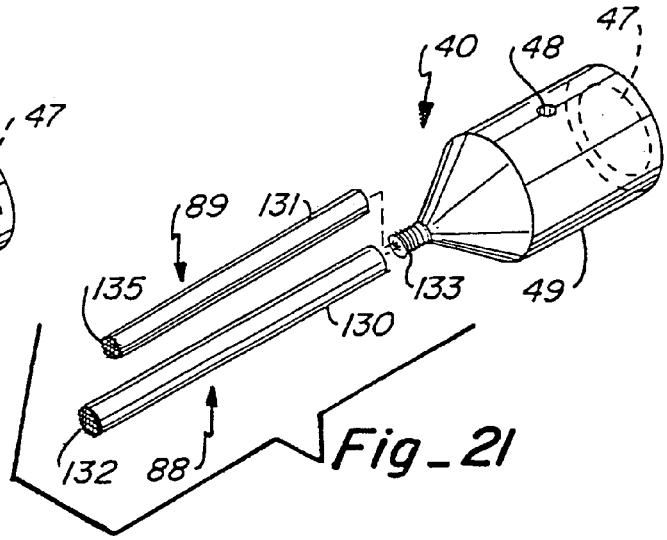

FIG. 21 illustrates rod-like tips 88 and 89 that can be further defined as including elongate shafts 130 and 131, respectively, and including serrated or waffle-like working ends 132 and 135 which extend transversely to the shafts 130 and 131. As also shown, rod-like tips 88 and 89 are of different lengths and diameters, and are interchangeable by connection to threaded end 133 of receiving section 49. Thus, the removable tips themselves can have removable sections. The shafts 130 and 131 can be defined as removable sections within the tips 88 and 89. The removable tip shown in FIG. 21 is especially adapted for use in applying a force to a difficult to reach location, particularly on the frame of a vehicle. For example, access ports are provided on the frame rail of a vehicle in order that a dent or kink in the rail can be accessed in the event the rail is damaged. Consequently, the small diameter shaft 130 is inserted through the particular access port enabling the working end 132 to contact the damaged area of the frame rail.

Figure 22:
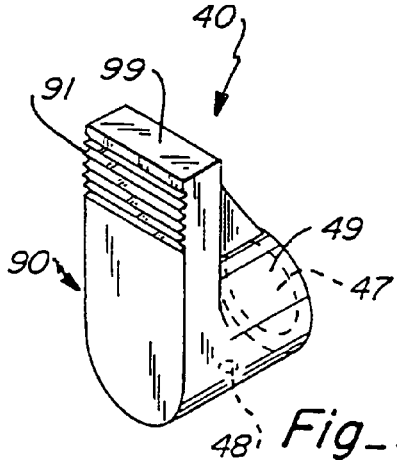

FIG. 22 illustrates a tip having a flat distal end 90 with grooves 91 located on a transversely extending flange 99. The removable tip shown in FIG. 22 is also especially adapted for accessing difficult to reach locations, for example, on the frame of a vehicle. Typically, tubing or hose extends along certain portions of the frame rail, such as brake lines and the like. In order to avoid damaging those elements, it is necessary to have an extension which may reach around a corner, or otherwise allow a force to be applied by the slide hammer which is not necessarily directly in line with the axis of the slide hammer. Accordingly, the removable tip of FIG. 22 may be used to access difficult to reach locations where the extension 99 is provided to apply the desired force at a location offset from the axis of the slide hammer.

Figure 23:
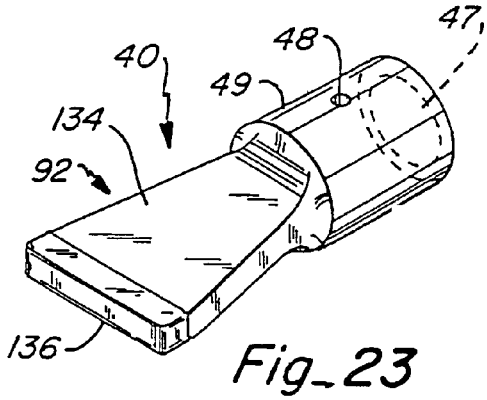

FIG. 23 illustrates a blunted, chisel-type tip 92 that can be further defined as including a shank 134 having substantially flat opposed sides, and a blunted rubber working end 136. The shank 134 progressively enlarges as it approaches the rubber working end 136.

Figure 24:
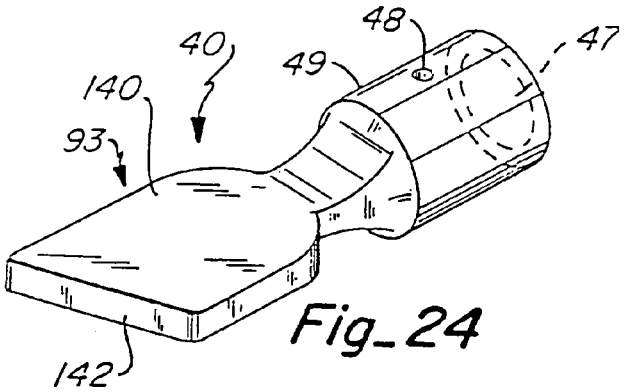

FIG. 24 illustrates a spatula shaped tip 93 that can be further defined as including a shank 140 having substantially flat opposed sides, and a substantially flat working end 142 extending transversely to the shank 140.

Figure 25:
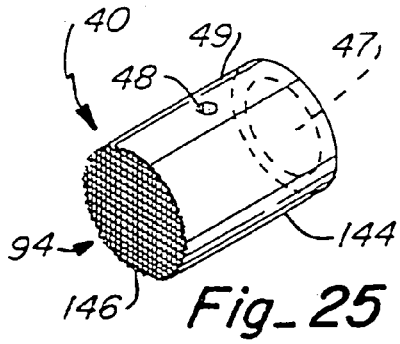

FIG. 25 illustrates a circular waffle-type tip that 94 can be further defined as including a cylindrical shaft 144 and a waffle or serrated working end 146 extending transversely to the shaft 144.

Figure 26:
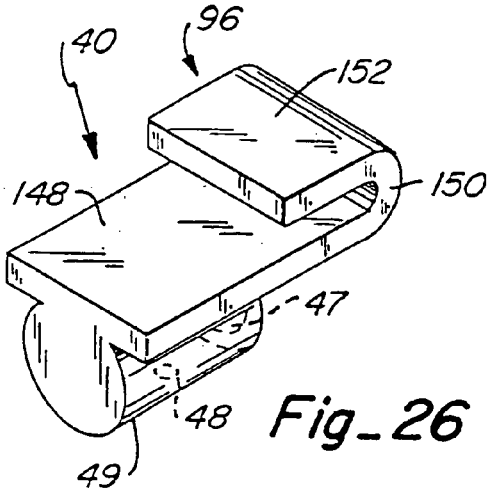

FIG. 26 illustrates a hook-type tip 96 that can be further defined as including a guide or supporting shank 148 which connects along the length of receiving section 49, a bend 150, and a reverse extending flange 152. This type of tip is ideal for straightening a twisted or bent frame of a vehicle. In use, a flange or channel of the frame at or near the twist/bend is inserted in the gap between supporting shank 148 and reverse extending flange 152. As force is applied to the slide hammer, the flange or channel of the frame remains captured between shank 148 and flange 152. Accordingly, the frame can be forced back to its original shape and orientation.

Figure 27:
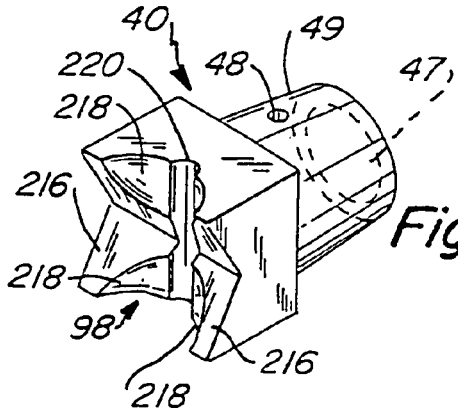

FIG. 27 illustrates a tip having an irregular surfaced end 98 ideally suited for applying a force at a multitude of different angles, and also to provide an impact surface which grips or hold the impacted surface. As shown, the tip includes a plurality of irregular shaped surfaces, shown as surfaces 216, 218, and 220. The cooperating arrangement of surfaces 216 enables force to be applied against a corner or protruding flange, such as on the frame of vehicle. The cooperating arrangement of surfaces 218 enables force to be applied against a rounded or cylindrical shaped object. Surface 220 is ideally suited for holding a smaller channel or protruding element to be contacted. Those skilled in the art can envision other specific uses for the arrangement shown in FIG. 27.

Figure 28:
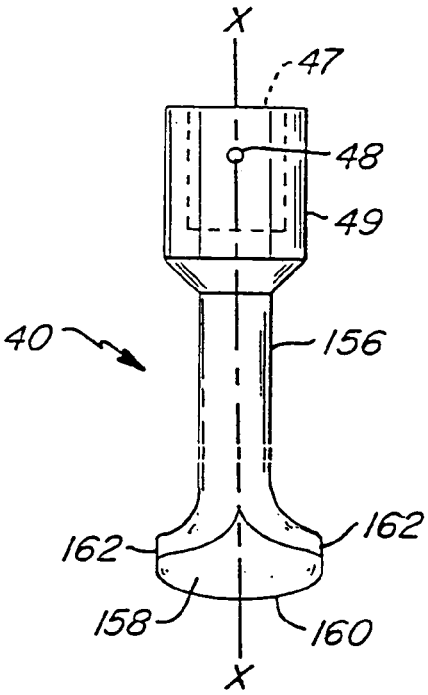
FIG. 28 is an enlarged plan view of another type of tip which may be used with the slide hammer.
Figure 29:
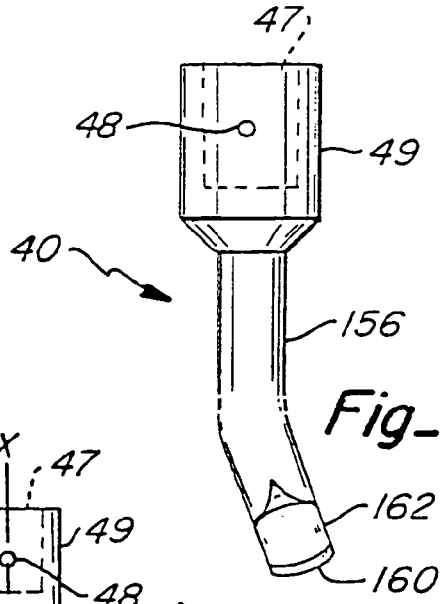
FIG. 29 is a side view of FIG. 28.

FIG. 28 shows a tip that can be described as a curved shaft flared chisel. As shown, the shaft 156 extends away from the receiving section 49. An enlarged transverse portion 158 is formed near the working end 160. FIG. 28 is a plan view of this particular removable tip. FIG. 29 is a side view of the tip of FIG. 28 which illustrates that the shank 156 is bent a desired angle. Side edges 162 are substantially flat and extend along the axis X—X.

Figure 30:
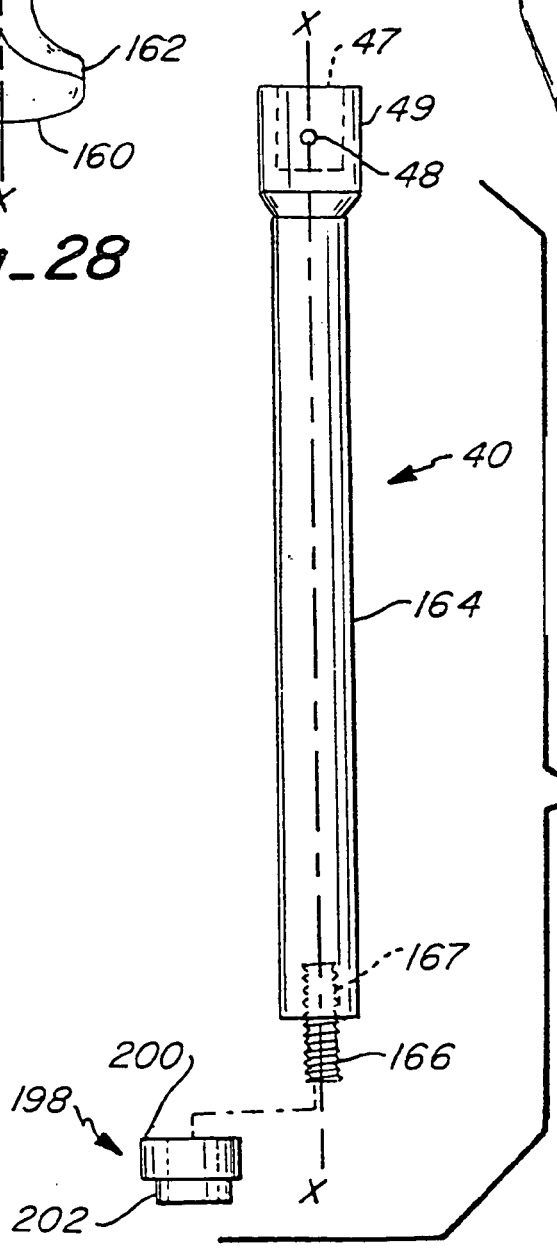
FIGS. 30–35 are enlarged plan views of additional types of tips which may be used with the slide hammer.

FIG. 30 illustrates yet another example of a removable tip which is especially adapted for a particular purpose, namely, for driving cam bearings in the camshaft of a vehicle. As shown, this removable tip includes an elongate shaft 164 with a threaded rod 166 secured within a threaded well 167. The free or distal end of threaded rod 166 is then inserted into a driving implement which directly contacts the cam bearing of a camshaft. As shown, the driving implement can be in the form of a plug 198 having a metallic or steel plate 200 and a rubber impact section 202. In use, the plug 198 is slipped over the threaded rod 166. The threaded rod is then inserted within a threaded well of the camshaft adjacent the cam bearing to be driven. The threaded rod is screwed tightly against the threaded well within the camshaft which compresses and flattens out the rubber impact section 202 positioned inside the race of the cam bearing. The plate 200 contacts the race of the bearing which enables the cam bearing to be manipulated by the force of the slide hammer.

Figure 31:
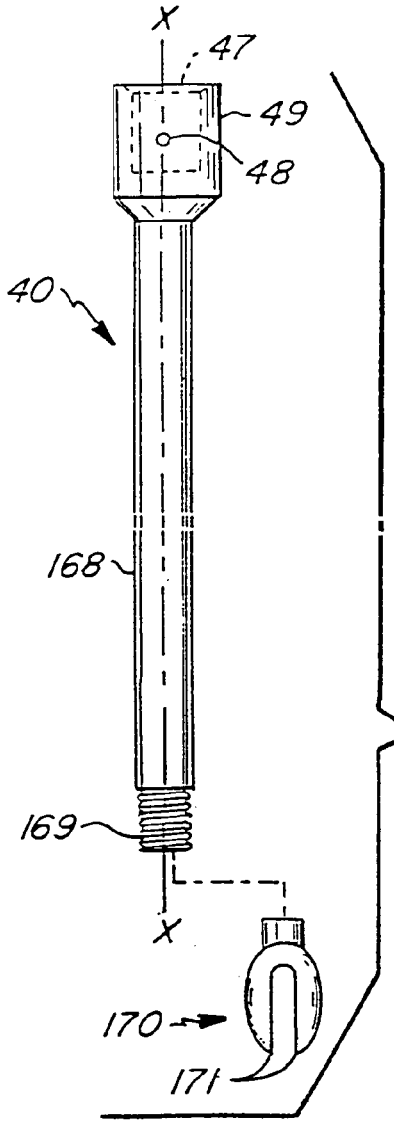

FIG. 31 illustrates yet another removable tip which is especially adapted for a particular purpose, namely, removing ball joints from the control rod of a vehicle. As shown, this removable tip includes a shaft 168, and a threaded distal end 169. A driving implement in the form of a fork 170 attaches to the threaded end 169. The fork 170 includes a pair of forked ends 171. In operation, the fork ends 171 are inserted over the ball joint of the vehicle. The ball joint is removed from the control arm when force is imparted on the fork 170 from the slide hammer.

Figure 32:
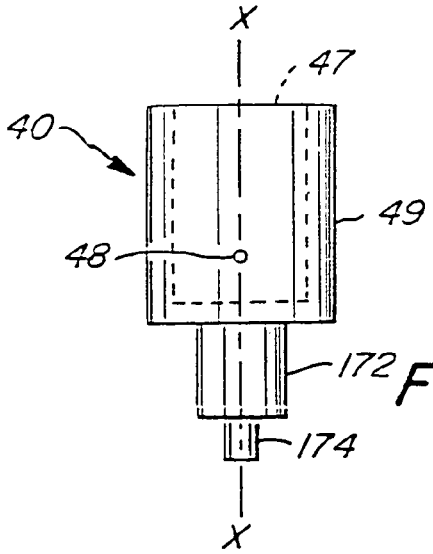

Yet another type of removable tip is shown in FIG. 32. This removable tip is ideally suited for driving bushings. As shown, this removable tip includes a cylindrical shank 172 and a smaller diameter working end 174. End 174 is sized to match the bushing to be removed/separated.

Figure 33:
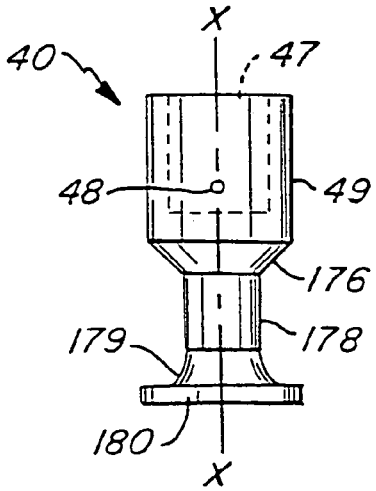

FIG. 33 illustrates yet another type of removable tip. This tip can be generally described as a shrinking round hammer end. As shown, this removable tip includes a converging neck 176, a straight shank 178, a diverging section 179, and a round shaped working end 180 with a flat impact face.

Figure 34:
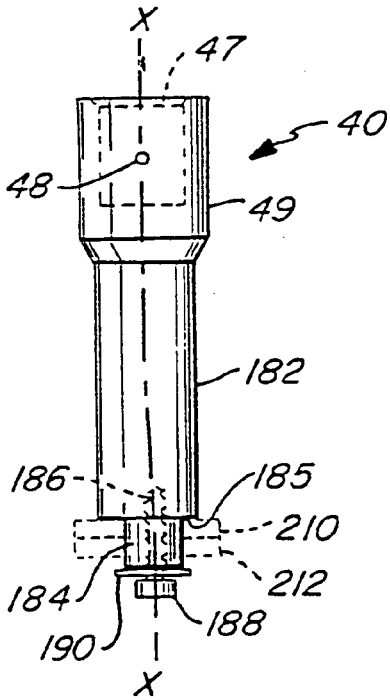

FIG. 34 illustrates yet another type of removable tip which is ideally suited for a particular purpose, namely, for driving a bushing and grease seal on the wheel of a vehicle. As shown, this removable tip includes a shaft 182, an extension 184, a securing washer 190, and a securing nut 188. A threaded rod/bolt 186 extends interiorly through extension 184 and partially into shaft 182. In operation, a circular sizing plate 210 having a central opening is slipped over extension 184, and rests against ledge 185. A matching sized grease seal 212 is then slipped over extension 184 against sizing plate 210. The purpose of securing nut 188 and securing washer 190 is simply to keep the sizing plate 210 attached to the removable tip. Of course, the diameter of the opening in grease seal 212 is large enough to slip over the securing washer 190. As needed, the sizing plate 210 is replaced with a sizing plate matching the particular sized grease seal. Because the slide hammer may apply a precisely aligned force against the removable tip shown in FIG. 24, the grease seal 212 may be placed within the wheel assembly without damage. As well understood by those skilled in the art, pounding in the grease seal 212 on a wheel assembly can result in damage to the grease seal if the grease seal is not precisely aligned when emplaced. With the slide hammer of this invention, the grease seal may be emplaced without damage because the slide hammer has the capability to impart an exact amount and direction of force.

Figure 35:
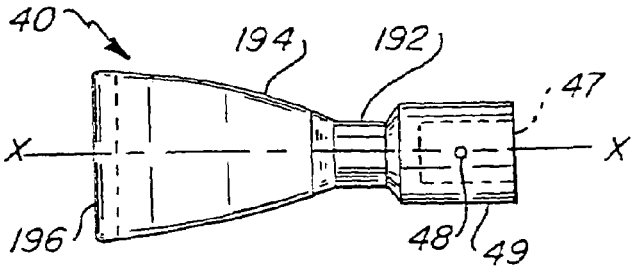
Figure 36:
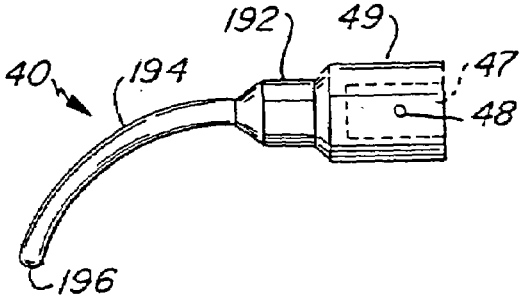
FIG. 36 is a side view of the tip illustrated in FIG. 35.

FIG. 35 is yet another example of a removable tip which may be used in conjunction with the slide hammer of this invention. As shown, this removable tip includes a neck 192, a diverging shank with substantially flat opposed sides 194, and a blunted working end 196. As shown in FIG. 36, the diverging shank 194 is also bent at an angle. Thus, like the tip shown in FIG. 18, force may be applied at the working end 196 in a direction which is different from the force applied by the slide hammer.

Figure 37:
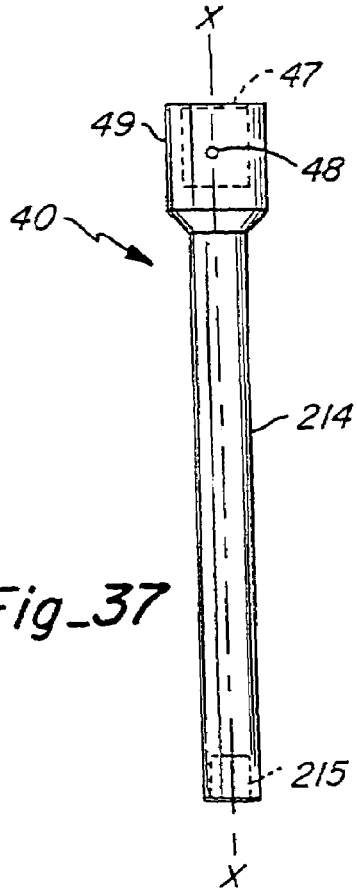
FIGS. 37–49 are enlarged plan views illustrating additional types of tips which may be used with the slide hammer.

FIG. 37 illustrates yet another example of a removable tip which may be used in conjunction with the slide hammer. As shown in this figure, this removable tip includes an elongate shaft or shank 214. The distal end of the shaft 214 includes a cylindrical shaped well or opening 215. This well or opening 215 is especially adapted for driving roll pins which may be used to secure an implement. For example, roll pins are used to connect track sections in a tracked vehicle, as well as replacement tips for construction equipment, like the replaceable tips used on the jaws of a bucket loader. In operation, the roll pin to be installed would have one end inserted within the well 215. The other end of the roll pin would be placed into/against the opening into which it is to be driven. The slide hammer could then impart a directed force to insert the one end of the roll pin into the opening. Then, the roll pin can be removed within the well 215 and the remaining length of the roll pin could be pounded into place.

Figure 38:
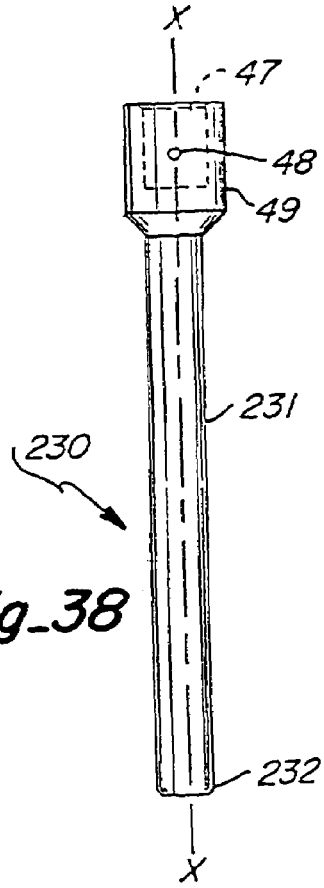

FIG. 38 illustrates an extension which may be attached to the impact head. As shown, the extension 230 includes an extension shaft 231, and a distal end 232 which is in the same shape and dimension as the distal end of the impact head. Accordingly, a removable tip would then be attached to the distal end 232 enabling the user to be able to further reach to a desired point of impact.

Figure 39:
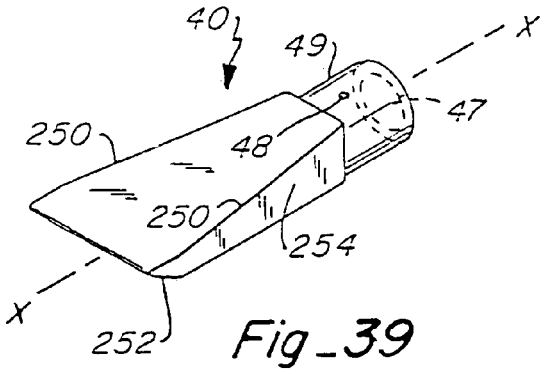

FIG. 39 illustrates another removable tip that may be used in conjunction with the slide hammer. This particular tip is characterized by a diverging shank 250, and a narrowing side edge 254 which progressively narrows toward the beveled tip 252. This particular removable tip is advantageous for use in connection with scraping floor tile and other hard to remove materials from flat surfaces.

Figure 40:
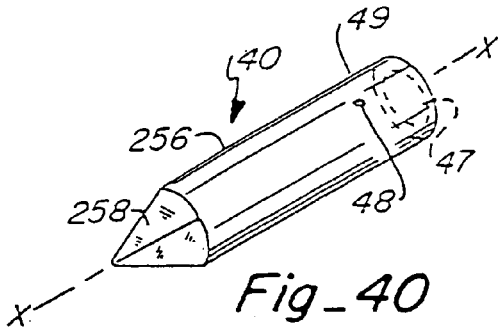

FIG. 40 shows another removable tip which is characterized by a cylindrical shank 256 having a pyramid shaped tip 258. The tip 258 may be three-sided, or could have yet additional sides which converge to form a point at the distal tip. This removable tip is particularly adapted for breaking apart concrete slabs, brick, mortar, and other stone materials.

Figure 41:
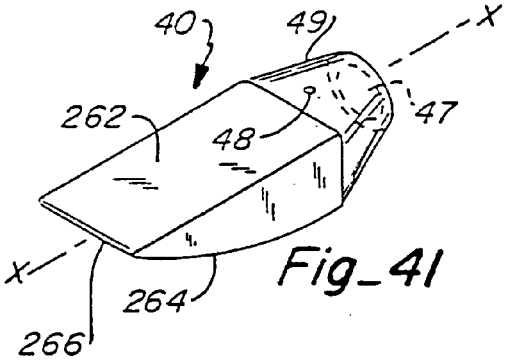

FIG. 41 illustrates another removable tip which is characterized by a parallel extending surface and an intersecting sloping side 264. Accordingly, a pointed tip or edge 266 extends along the transverse width of surface 262. As with the tip shown in FIG. 40, this removable tip is also well suited for breaking apart concrete, brick and other stone materials.

Figure 42:
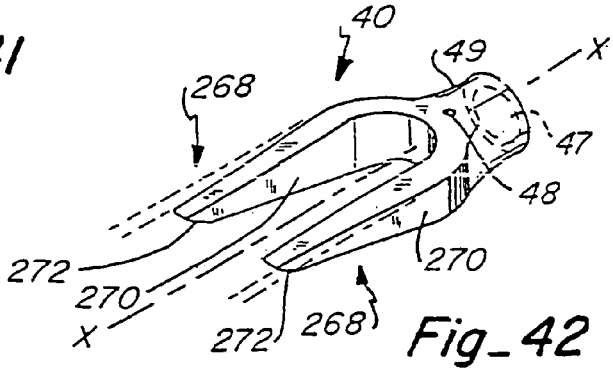

FIG. 42 illustrates a tip that is characterized by a pair of extensions 268 which form a forked end, the extensions extending substantially parallel to one another. Each of the extensions 268 has a narrowing side edge 270 which narrows towards the respective beveled tip 272. This particular removable tip has many contemplated uses to include prying and scraping. Additionally, the forked arrangement allows a user to impart a force on both sides of an object which is placed between the extensions 268.

Figure 43:
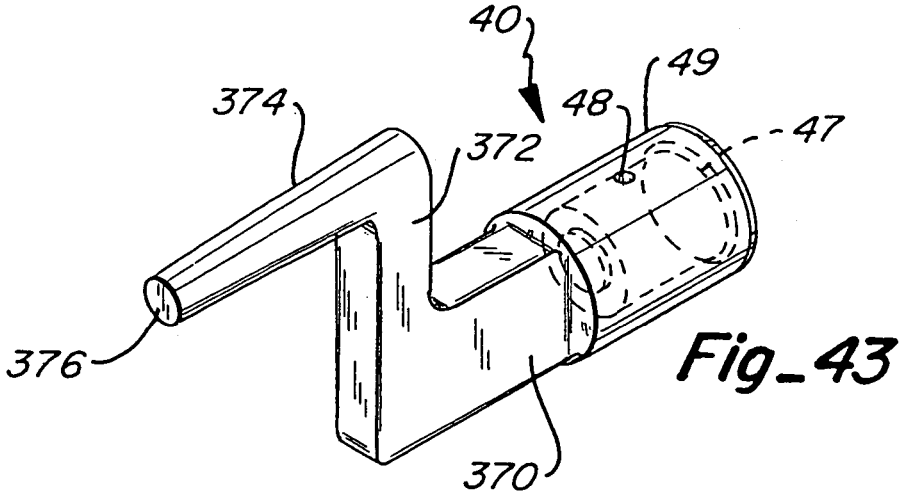

FIG. 43 illustrates another removable tip characterized by a shank 370, a turn or angled portion 372, and an offset extension 374. The working end 376 is preferably cylindrical shaped. This tool is particularly advantageous for removing the teeth on large construction equipment such as scoop loaders, or other similar equipment. The roll pin (not shown) which holds the particular tooth (not shown) in place must be accessed at an angle. The offset provided by the angle section 372 allows the user to thereby more conveniently access the pin holding the tooth in place.

Figure 44:
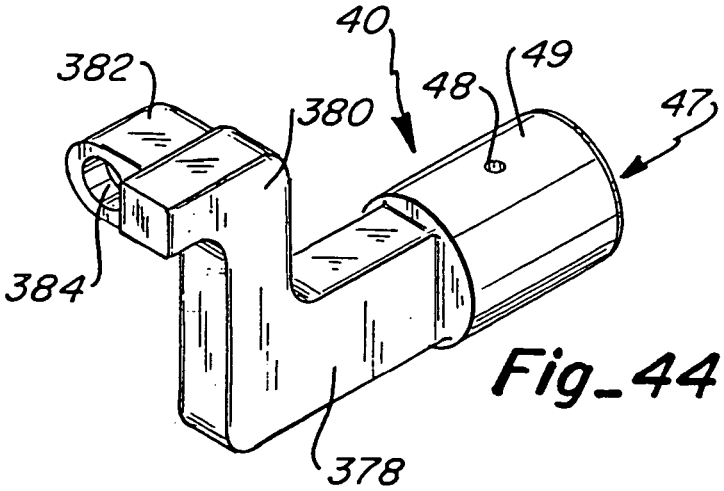

FIG. 44 illustrates another removable tip characterized by a shank 378, an angle or turn 380, and a side mount section 382 having a well 384 formed therein. This particular type of tip is particularly advantageous for installing or driving the roll pins in equipment having removable teeth. Accordingly, the proximal end of a roll pin (not shown) is inserted within the well 384, and then force is applied to install the roll pin.

Figure 45:
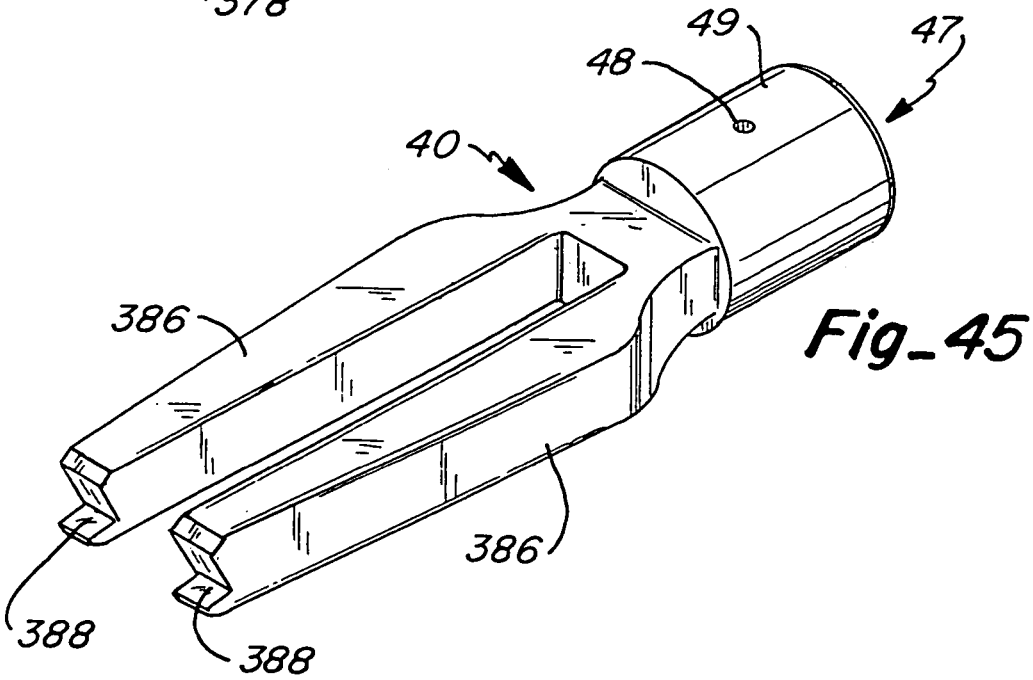

FIG. 45 illustrates another removable tip characterized by a pair of forks 386, and a pair of notches 388 formed in the distal ends of the forks 386. This tip 40 is a known commercial tool used for installing scarifying teeth on a motor grader.

Figure 46:
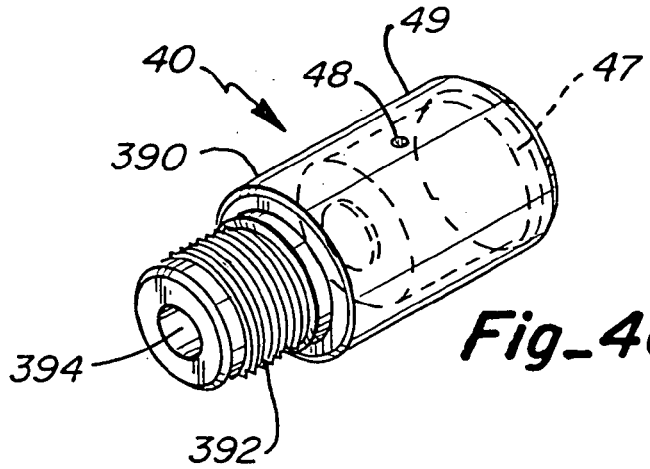

Referring to FIG. 46, another removable tip is shown in the form of an adapter which is used to receive auto body chisels. The tip includes a shank 390, a distal threaded section 392, and an opening 394 formed in the threaded section 392.

Figure 47:
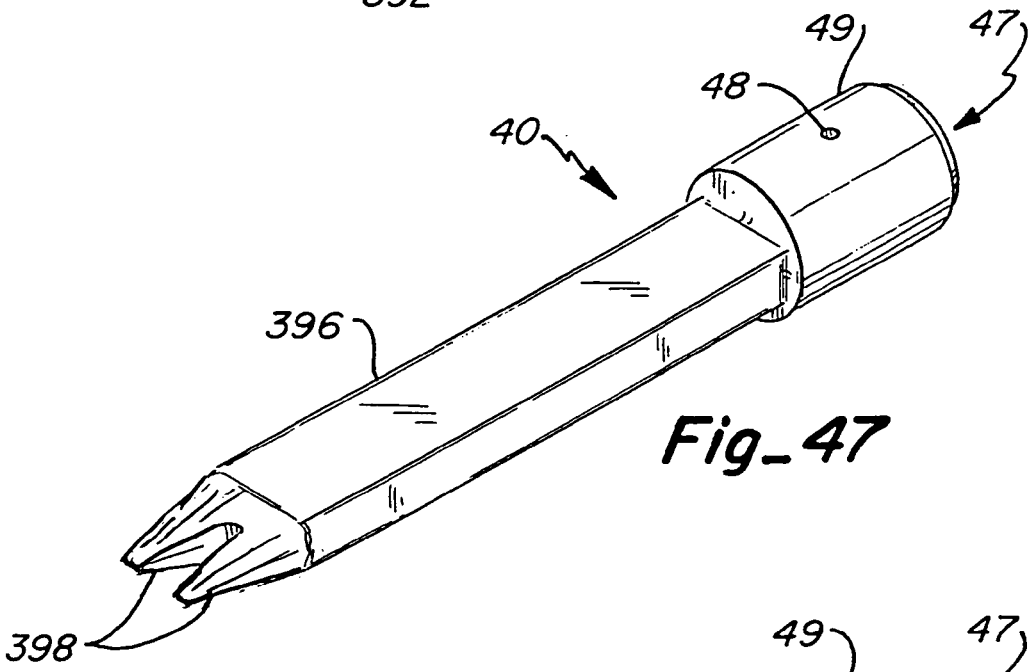

FIG. 47 illustrates another tip 40 characterized by a shank 396, and a pair of conical extensions 398 that terminate with chisel type ends. This tool is especially adapted for removing and installing hammer pins on large construction equipment, such as the drive bar on a corn harvester.

Figure 48:
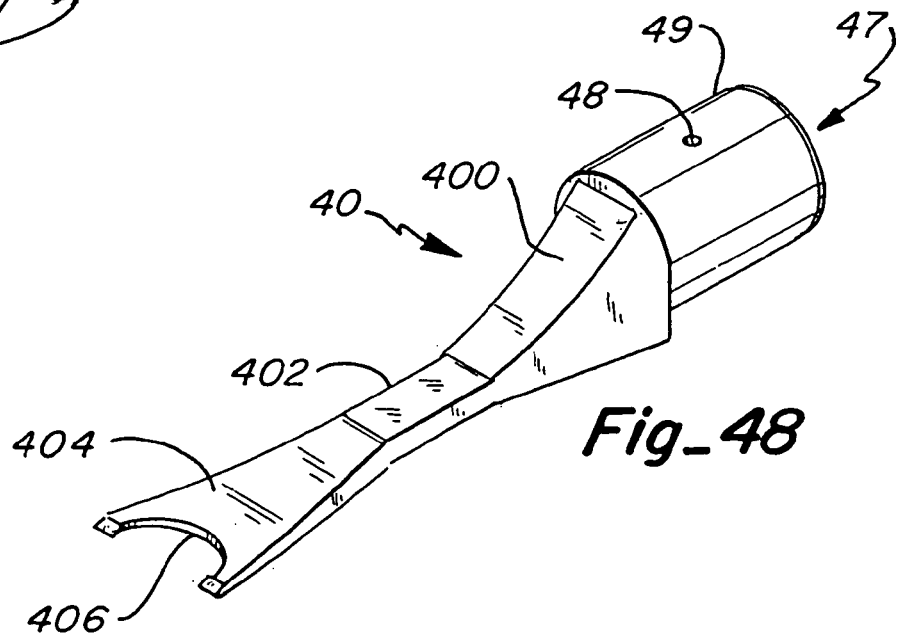

FIG. 48 illustrates yet another type of tip 40 characterized by a converging shank section 400, an extension 402, and a pry portion 404 including a beveled elliptical or semicircular shaped edge 406. This tip is especially adapted for shearing off nail heads by placing the beveled portion 406 under the head of the nail and then shearing the head of the nail off by providing a force from the slide hammer.

Figure 49:
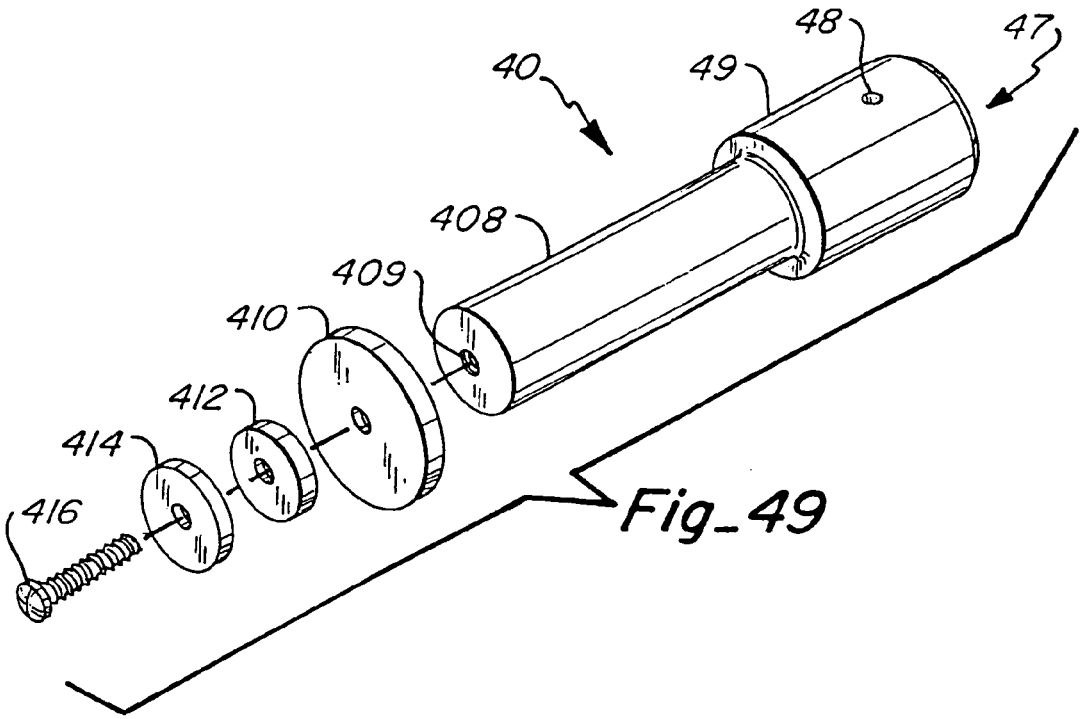

FIG. 49 illustrates yet another example of a tip 40. This tip is characterized by a shaft 408 which is adapted to receive a securing screw 416 in an opening 409 formed within the distal end of the shaft 408. One or more spaces or disks may be provided between the screw 416 and the shaft 408. This tip is especially adapted for installing or removing bearings. For example, the tip may be used in conjunction with a driver disk 410, a spacer disk 412, and a pilot disk 414. As understood by those skilled in the art, the driver disk 410 is sized to match the diameter of a particular bearing (not shown) for driving the bearing cup (not shown) of the bearing into a bearing housing (not shown). The pilot disk 414 is sized to match the central opening within the bearing.

This invention has been described in detail with reference to a particular embodiment thereof, but it will be understood that various other modifications can be effected within the spirit and scope of this invention.

What is claimed is:

1. A method of transferring force in a directionally and force controlled manner to a targeted object, said method comprising the steps of:

providing a device including a (i) guide sleeve with a longitudinal passageway therethrough, (ii) and an impact head receiving section attached to a distal end of the guide sleeve, said impact head receiving section having a proximal stop formed at a connection to the guide sleeve and having a distal stop, an open space being defined between said proximal and distal stops;

providing an impact head having a proximal end received in said open space, said proximal end being defined by a slide portion that is slidable in said open space, and said impact head further having an impact extension which extends distally beyond said distal stop;

inserting a plunger in said longitudinal passageway;

attaching a removable tip to said impact extension;

orienting said guide sleeve in a direction for which force is to be directed toward the object to be contacted;

sliding the plunger in the guide sleeve by maintaining the guide sleeve in a fixed position and moving the plunger at a desired speed to contact the impact head with a desired force, the contact of the plunger with the impact head occurring within the open space;

sliding the impact head in response to the forced transferred from the plunger and maintaining the slide portion of said impact head within the open space, said distal stop defining a limit of travel for the slide portion; and contacting the object with the removable tip.

2. A method, as claimed in claim 1, further including the steps of:

removing said removable tip;

attaching a second removable tip to said impact extension;

sliding the plunger in the guide sleeve at a desired speed to contact the impact head with a desired force;

sliding the impact head in response to the force transferred from the plunger; and contacting the object with the second removable tip.

* * * * *

UNITED STATES PATENT AND TRADEMARK OFFICE

CERTIFICATE OF CORRECTION

PATENT NO. : 7,191,685 B2
APPLICATION NO. : 10/613777
DATED : March 20, 2007
INVENTOR(S) : Lowther It is certified that error appears in the above-identified patent and that said Letters Patent is hereby corrected as shown below:

On the title page: item [54] and Column 1, please delete "Objected" and replace with --Object--

Signed and Sealed this

Twenty-third Day of October, 2007

JON W. DUDAS
*Director of the United States Patent and Trademark Office*